US007380308B2

(12) United States Patent
Oh et al.

(10) Patent No.: US 7,380,308 B2
(45) Date of Patent: Jun. 3, 2008

(54) VACUUM CLEANER

(75) Inventors: Jang-keun Oh, Gwangju (KR); Ki-man Kim, Gwangju (KR); Kyoung-woung Kim, Gwangju (KR); Jung-gyun Han, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 244 days.

(21) Appl. No.: 11/202,214

(22) Filed: Aug. 12, 2005

(65) Prior Publication Data

US 2006/0101609 A1 May 18, 2006

(30) Foreign Application Priority Data

Nov. 16, 2004 (KR) ..... 10-2004-0093413
Apr. 13, 2005 (KR) ..... 10-2005-0030611

(51) Int. Cl.
*A47L 9/00* (2006.01)

(52) U.S. Cl. ..... 15/327.2; 55/429; 55/493; 55/DIG. 3

(58) Field of Classification Search ..... None
See application file for complete search history.

(56) References Cited

U.S. PATENT DOCUMENTS 2,766,844 A * 10/1956 Humphrey ..... 55/372
6,766,588 B1 * 7/2004 Hsu ..... 33/755

FOREIGN PATENT DOCUMENTS

| | | |
|---|---|---|
| CN | 1361673 | 7/2000 |
| DE | 2532899 | 2/1977 |
| EP | 0956806 | 11/1999 |
| GB | 682845 | 11/1952 |
| GB | 2383527 | 7/2003 |
| JP | 55024080 | 2/1980 |
| JP | 2002-282178 | 10/2002 |
| KR | 96-005455 | 4/1996 |
| KR | 2000-007813 | 2/2000 |
| KR | 2001-0091904 | 10/2001 |
| SU | 1358923 | 1/1986 |
| SU | 1708291 | 7/1989 |
| WO | WO-0267756 | 9/2002 |

OTHER PUBLICATIONS

Australian Patent Office, Office Action dated Sep. 7, 2006, with respect to Australian Patent Application No. 2005211697 filed on Sep. 26, 2005.
Russian Federation Office Action dated Nov. 28, 2006.
People's Republic of China Office Action dated Dec. 22, 2006.
European Patent Office, Extended European Search Report dated Apr. 5, 2007, issued with respect to the European Patent Application No. 05291769.7, filed on May 17, 2006.

* cited by examiner

*Primary Examiner*—David A Redding
(74) *Attorney, Agent, or Firm*—Blank Rome LLP

(57) ABSTRACT

A vacuum cleaner comprises a cleaner body where a dust separator is mounted to extract dust from dust-laden air. A dust receptacle is detachably mounted in the cleaner body. A locking unit locks the dust separator and the dust receptacle together. In an exemplary embodiment, an opening unit rotates the dust separator by a predetermined angle when the dust separator and the dust receptacle are unlocked.

10 Claims, 5 Drawing Sheets

VACUUM CLEANER

This application claims benefit under 35 U.S.C. § 119(a) of Korean Patent Applications No. 2004-93413 filed Nov. 16, 2004 and No. 2005-30611 filed Apr. 13, 2005, the entire contents of which are incorporated herein by reference.

BACKGROUND OF THE INVENTION

1. Field of the Invention

The present invention relates generally to the field of vacuum cleaners.

2. Description of the Related Art

Generally, a dust collecting apparatus, which separates and collects dust from dust-laden air, comprises a dust separator for removing dust from the dust-laden air and a dust receptacle for collecting the removed dust.

As disclosed in Japanese Patent Laid-open No. 2003-180569 and Korean Patent Laid-open No. 2003-0038415, such a dust collecting apparatus is detachably mounted to a main body of the vacuum cleaner so that the dust receptacle can be emptied after collecting the dust therein. Therefore, a user first has to remove the dust collecting apparatus from the vacuum cleaner and then detach the dust separator from the dust receptacle to empty the dust receptacle.

However, the inventors have determined that this conventional two-step separation system, involving removing the dust collecting apparatus from the vacuum cleaner and then separating the dust separator from the dust receptacle, may be troublesome for the user. Furthermore, since the user has to apply a certain force to separate the dust separator from the dust receptacle, the dust may be shaken out by the force applied during the separation and contaminate the user's hand or other areas.

SUMMARY OF THE INVENTION

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In some embodiments, the invention solves at least some of the above problems and/or disadvantages and may provide one or more of the advantages described below. Accordingly, in exemplary embodiments, a vacuum cleaner is provided in which only a dust receptacle, instead of an entire dust collecting apparatus, is separated from the vacuum cleaner to remove collected dust.

In other embodiments, a vacuum cleaner is designed to enable convenient separation of the dust receptacle.

Embodiments disclosed herein provide a vacuum cleaner comprising a cleaner body in which a dust separator is rotatably mounted to extract dust from dust-laden air; a dust receptacle is detachably mounted in the cleaner body and disposed below the dust separator; a locking unit locks and releases the dust separator and the dust receptacle with respect to each other; and an opening unit rotates the dust separator by a predetermined angle when the dust separator and the dust receptacle are released from each other. The dust separator may comprise a mono-cyclone unit or a multi-cyclone unit.

In some embodiments, the vacuum cleaner further comprises a cover rotatably mounted to the cleaner body, and the dust separator is connected to the cover.

In certain embodiments, the locking unit comprises a button formed on a handle of the dust receptacle and having a hook; a fastening part provided to the dust separator to lock and release the hook; and a first resilient member pressing the button in a direction for locking the hook.

The fastening part may comprise, for example, a supporting projection protruding from the dust separator, and a hook holder formed on a lower part of the supporting projection.

The opening unit may comprise, for example, a static member fixed on the cleaner body; a guide mounted to the static member; a moving member mounted to the guide and moving between a first position and a second position; and a second resilient member interposed between the static member and the moving member to resiliently bias the moving member toward the second position. The guide may comprise a first guide guiding a left side of the moving member; and a second guide fixed into a second guide insertion hole of the moving member. The second resilient member may be inserted in the second guide.

BRIEF DESCRIPTION OF THE DRAWING FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE EXEMPLARY EMBODIMENTS

Figure 1:
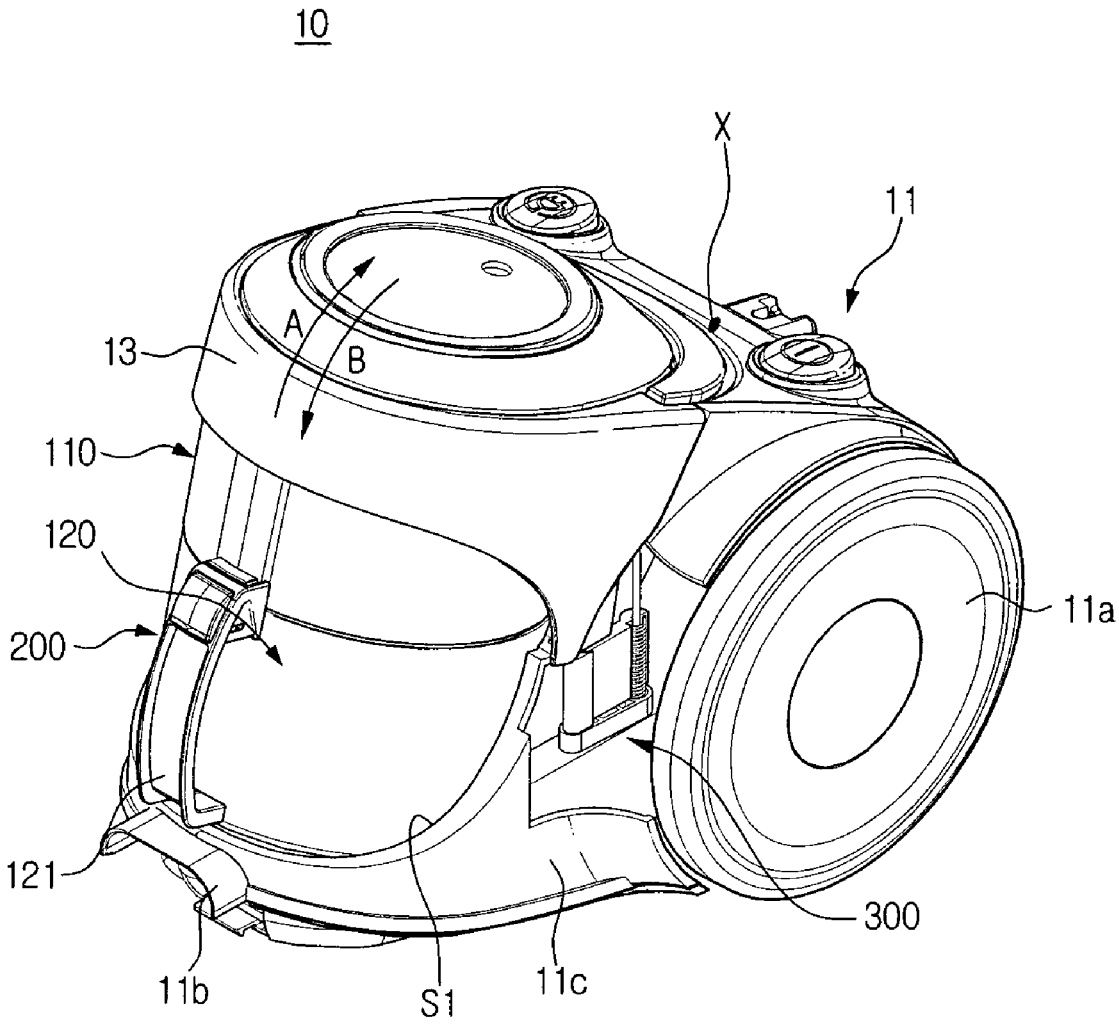
FIG. 1 is a perspective view of a vacuum cleaner according to an exemplary embodiment of the present invention.

Hereinafter, a certain embodiment of the present invention will be described in detail with reference to the accompanying drawing figures.

The present invention will now be explained in terms of exemplary embodiments. This specification discloses one or more embodiments that incorporate the features of this invention. The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, persons skilled in the art may effect such feature, structure, or characteristic in connection with other embodiments whether or not explicitly described.

In the following description, similar drawing reference numerals may be used for the same elements even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

Referring to FIG. 1, a vacuum cleaner 10 according to an embodiment of the present invention, comprises a cleaner body 11, a cover 13, a dust separator 110, a dust receptacle 120, a locking unit 200 and an opening unit 300.

The cleaner body 11 has wheels 11*a* rotatably mounted on opposite sides thereof, and a suction pipe 11*b* at one side thereof, which is connected to an extension pipe (not shown). A suction force of a built-in vacuum source (not shown) is transmitted through the suction pipe 11*b* so that dust on a surface being cleaned is drawn into the separator collector 110, passed through the extension pipe and the suction pipe 11*b*.

A dust collecting chamber S1 is provided in the cleaner body 11 to mount the dust receptacle 120. By mounting the dust receptacle 120 in the dust collecting chamber S1, a lower part of the dust receptacle 120 is enclosed by a sidewall 11*c* that constitutes the dust collecting chamber S1 so that airflow is restricted.

The cover 13 is rotatably mounted to the cleaner body 11. For this, the cover 13 is hinged on a hinge shaft X of the cleaner body 11 to pivot on the hinge shaft X by a predetermined angle in the direction of arrows A and B.

The dust separator 110 separates dust from external air which is drawn in through the suction pipe 11*b* by the vacuum source (not shown). The dust separator 110 may comprise a mono-cyclone unit or a multi-cyclone unit. Otherwise, the dust separator 110 may separate dust using a plurality of filters instead of employing the cyclone system. Since the inner operating principles of dust separator 110 are not critical to the implementation of the present invention, detailed description thereof will be omitted.

Preferably, the dust separator 110 is detachably mounted to the cover 13 for easier maintenance and management although the dust separator 110 can be rotatably fixed to the cleaner body 11 without the cover 13. When the dust separator 110 is separated from the dust receptacle 120, the dust receptacle 110 is able to rotate about the hinge shaft X in the direction of arrows A and B together with the cover 13. Rotation of the cover 13 and the dust separator 110 in the direction A is facilitated by the sloped shape of the bottom of the dust collecting chamber S1.

The dust receptacle 120 is connected to a lower part of the dust separator 110 to store the dust removed by the dust separator 110. Also, the dust receptacle 120 has a handle 121 for a user to grip when emptying the dust receptacle 120.

Figure 2:
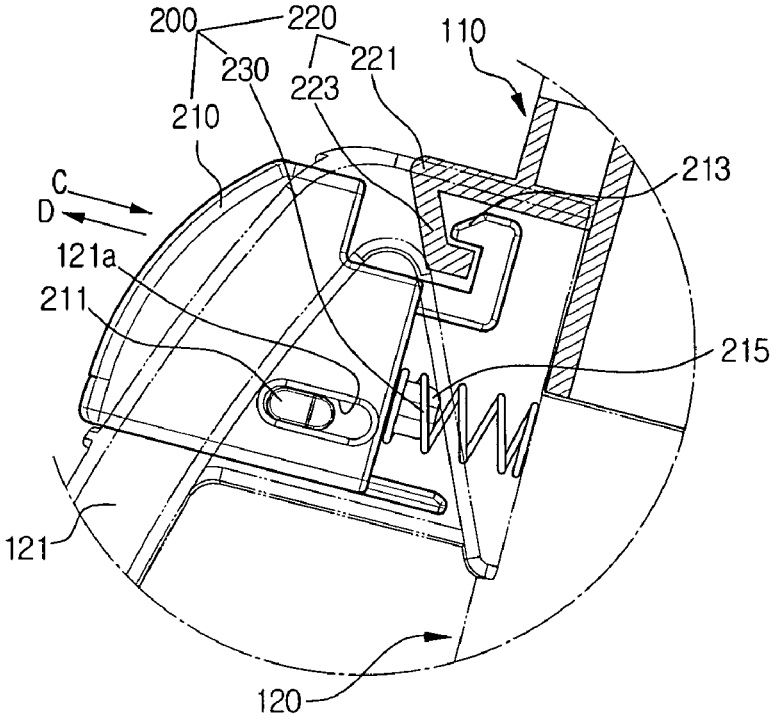
FIG. 2 is an enlarged, perspective view of a locking unit in FIG. 1.

Referring to FIG. 2, a locking unit 200 locks and releases the dust receptacle 120 with respect to the dust separator 110. To this end, the locking unit 200 comprises a button 210, a fastening part 220 and a first resilient member 230.

The button 210 is mounted to the handle 121 of the dust receptacle 120 to move in the direction of arrows C and D. Guide projections 211 are formed on opposite sides of the button 210 whereas guide grooves 121*a* for insertion of the guide projections 211 are formed on opposite sides of the handle 121. Additionally, a hook 213 is provided to an end of the button 210 to be fastened or released by the fastening part 220.

The fastening part 220 is formed at the dust separator 110 to correspond to the hook 213. The fastening part 220 comprises a supporting projection 221 protruded on the dust separator 110 and a hook holder 223 disposed at a lower part of the supporting projection 221 and directly locked or released with respect to the hook 213. The fastening part 220 may be formed integrally with the dust separator 110 or formed as a separate part to be welded or attached onto the dust separator 110.

The first resilient member 230 is interposed between the button 210 and the dust receptacle 120 and constantly biases the button 210 in the direction D which is a locking direction.

A resilient-member insertion projection 215 is formed at the button 210 to mount the first resilient member 230. One side of the first resilient member 230 is fit around the resilient-member insertion projection 215. For the first resilient member 230, any other material instead of the coil spring can be used as long as it has resiliency. By existence of the first resilient member 230, if the button 210 is not pressed in the direction of arrow C, the button 210 can be kept in a locking position where the hook 213 and the hook holder 223 are engaged, as shown in FIG. 2.

Using the locking unit 200, therefore, the dust receptacle 120 can be drawn from the cleaner body 11 by itself. As a result, the user can easily remove the dust collected in the dust receptacle. Also, because minimal force is required to release dust receptacle 120 from the dust separator 110, the dust does not easily bounce out from the dust receptacle 120 due to the applied force to contaminate the user's hand.

Figure 3:
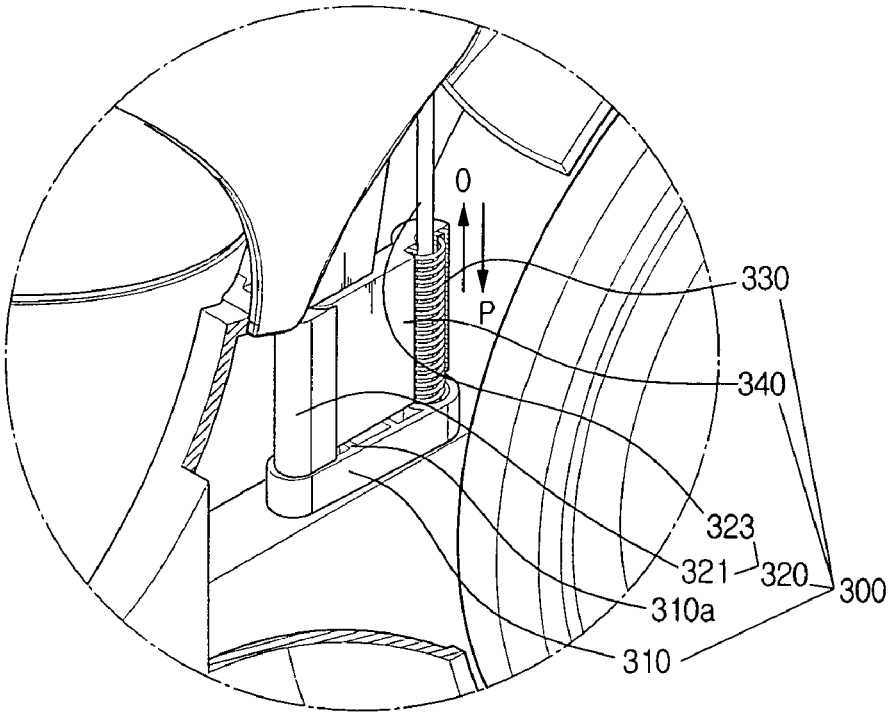
FIG. 3 is an enlarged, perspective view of an opening unit in FIG. 1.
Figure 6:
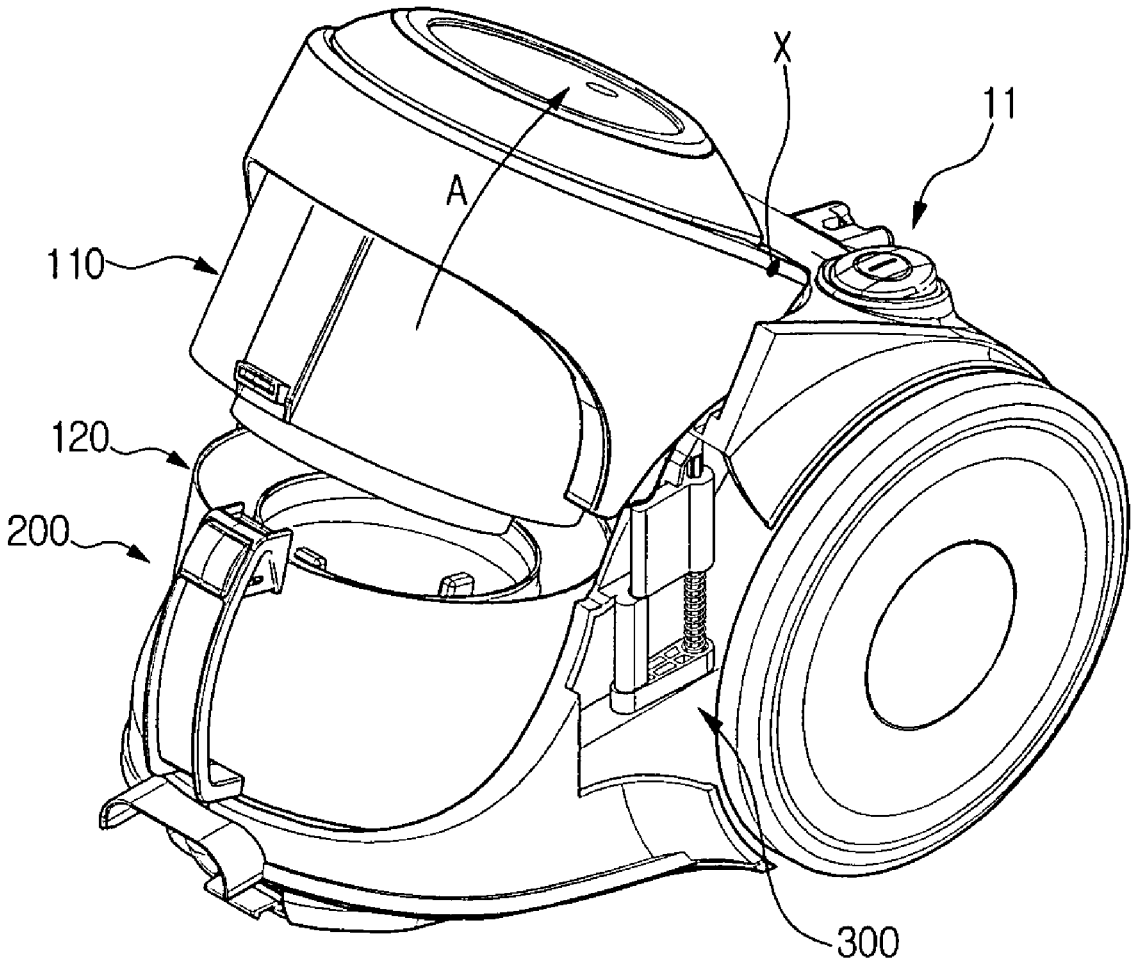
FIG. 6 shows a dust separator of FIG. 1, in a position where it is separated from a dust receptacle of FIG. 1 and rotated.

Referring to FIG. 3, when the dust separator 110 (FIG. 1) and the dust receptacle 120 (FIG. 1) are released from each other, the opening unit 300 automatically rotates the dust separator 110 in the direction of arrow B by a predetermined distance, as shown in FIG. 6. To this end, the opening unit 300 comprises a static member 310, a guide 320, a second resilient member 330 and a moving member 340.

The static member 310 is mounted in the cleaner body 11 to serve as a supporting block. The static member 310 may be formed integrally with the cleaner body 11 or may be separately formed and welded or otherwise attached to the cleaner body 11.

The guide 320 is mounted on a static top side 310*a* of the static member 310 to guide a vertical movement of the moving member 340 in the directions of arrows O and P. To accomplish this, the guide 320 comprises a first guide 321 and a second guide 323.

The first guide 321 is disposed on the left of the static top side 310*a* of the static member 310. The first guide 321 includes a rounded guide groove 321*a* (FIG. 5) having a corresponding form to a left side 340*a* (FIG. 5) of the moving member 340.

Figure 5:
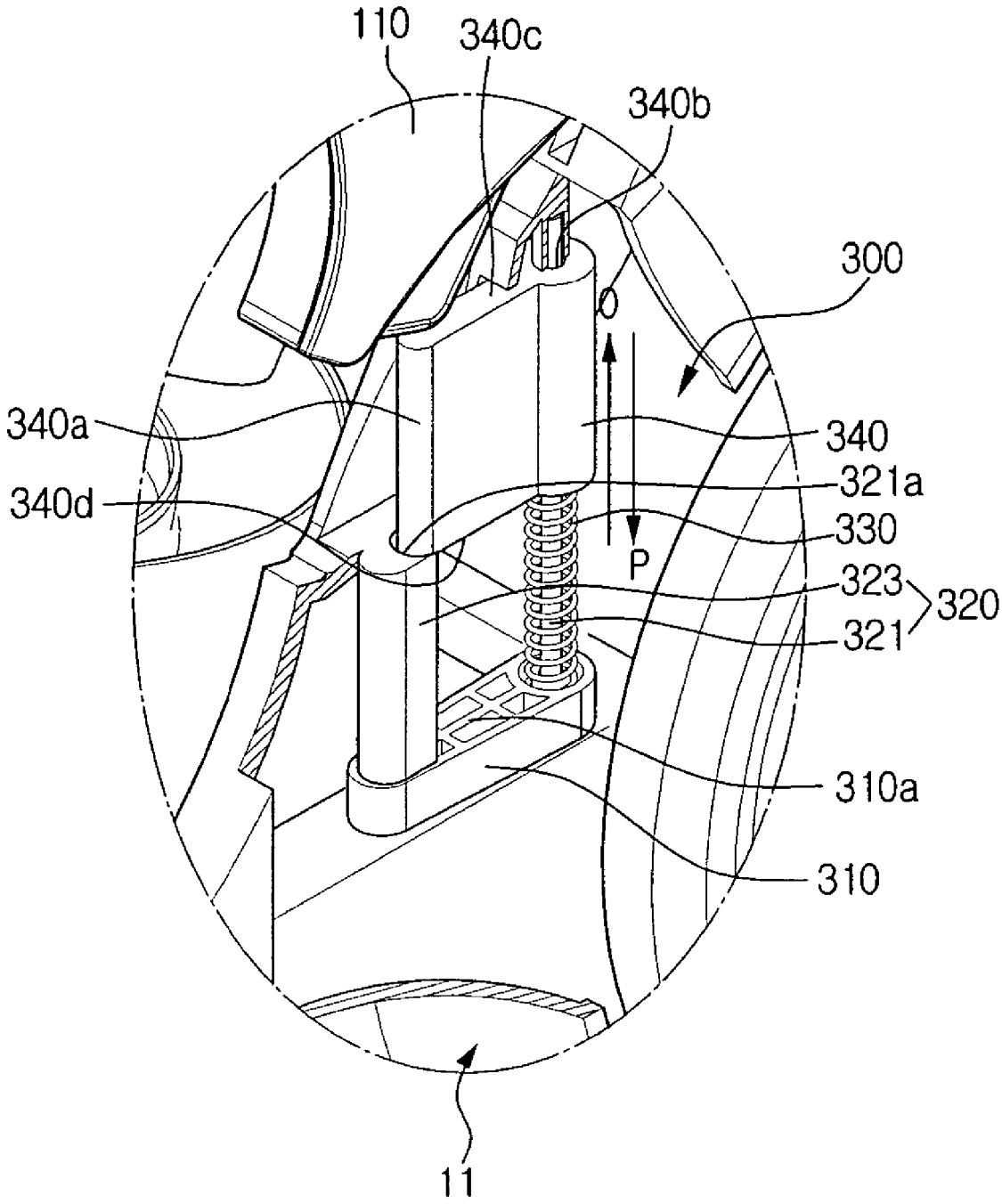
FIG. 5 shows a second resilient member of the opening unit of FIG. 3 in an extended position.

The second guide 323 is disposed on the right of the static top side 310*a* of the static member 310 and is fixed into a second guide insertion hole 340*b* (FIG. 5).

The second resilient member 330 is implemented by a coil spring disposed between the static member 310 and the moving member 340 and inserted into the second guide 323. The second resilient member 340 resiliently biases the moving member 340 in the direction of arrow O, that is, to a second position shown in FIG. 5. In other words, the second resilient member 330 is compressed as shown in FIG. 3 when the dust separator 110 (FIG. 1) and the dust receptacle 120 (FIG. 2) are in the locking position; however, as the dust separator 110 (FIG. 1) and the dust receptacle 120 (FIG. 2) are released from each other, the second resilient member 330 is extended and thereby presses the dust separator 110 (FIG. 1) in the arrowed direction O so that the dust separator 110 is rotated about the hinge shaft X (FIG. 1) in the arrowed direction A, as shown in FIG. 6.

Referring to FIG. 5, as it moves along the guide 320 in the directions O and P, the moving member 340 presses against one side of the dust separator 110 with a moving top side 340*c* thereof. More specifically, when the hook 213 (FIG. 2) is separated from the hook holder 223 (FIG. 2), the moving member 340 is moved by the second resilient member 330, pushing out the dust separator 110 from a first position as shown in FIG. 3 to a second position as shown in FIG. 5.

The left side 340*a* of the moving member 340 has a rounded shape corresponding to the guide groove 321*a*. The second guide insertion hole 340*b* is vertically formed on the moving top side 340*c* of the moving member 340. The moving member 340 is vertically guided in the directions of arrows O and P by the first guide 321 guiding the left side 340*a* of the moving member 340 and the second guide 323 inserted in the second guide insertion hole 340*b*.

Referring to FIG. 6, when the dust separator 110 is released from the dust receptacle 120, the dust separator 110 is automatically rotated about the hinge shaft X in direction A, due to the opening unit 300, without the user manually rotating the dust separator 110 in direction A. As a result, the user can easily remove dust receptacle 120 without having to rotate the dust separator 110 in direction A.

Hereinbelow, the process for removing the dust receptacle 120 will be described.

Figure 4:
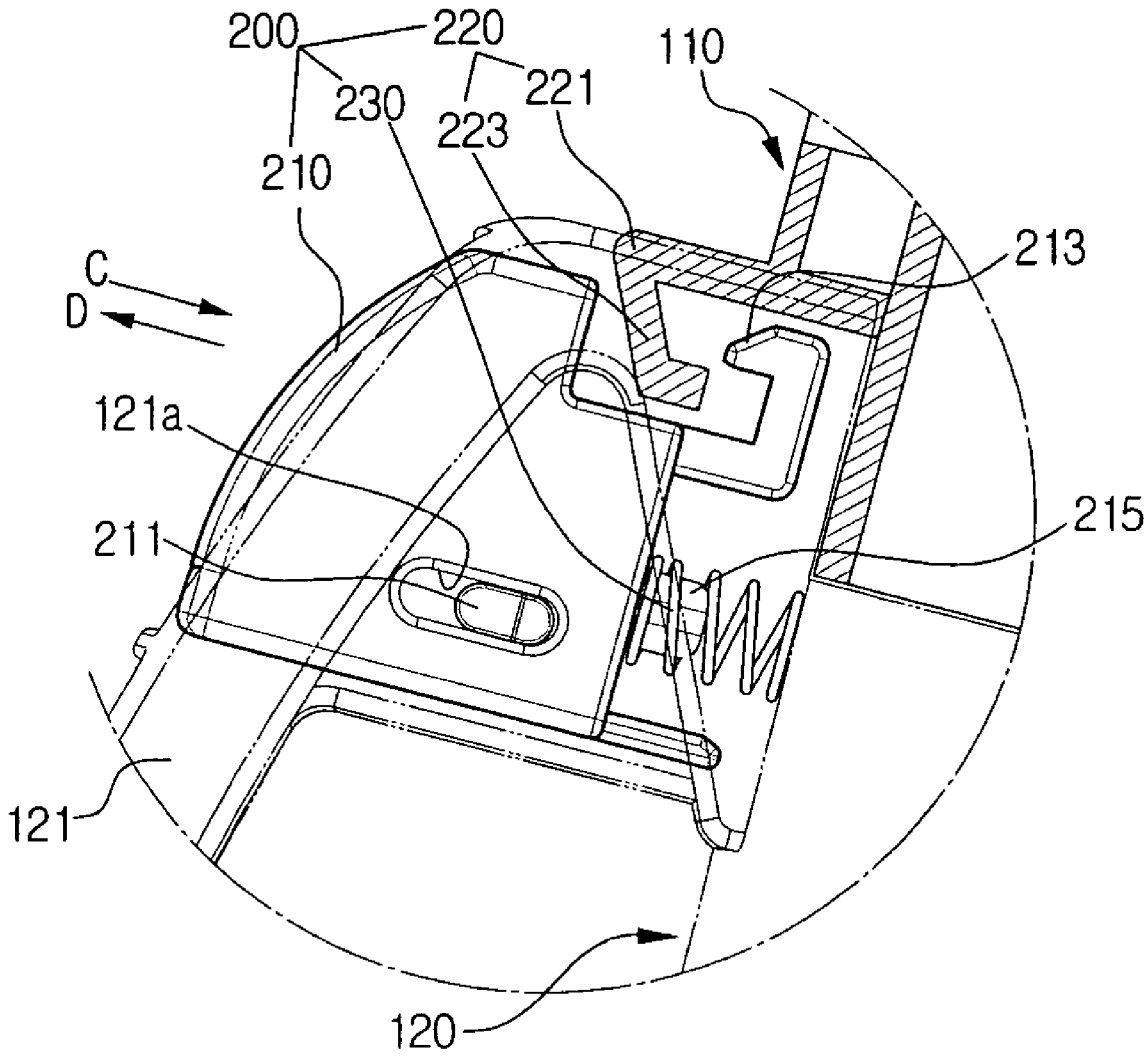
FIG. 4 shows a button of the locking unit of FIG. 2, as being pressed.

Referring to FIG. 4, as the user presses the button 210 in the direction of arrow C, the hook 213 is separated from the hook holder 223, thereby releasing the dust separator 110 from the dust receptacle 120. Therefore, the second resilient member 330 is extended as shown in FIG. 5, thereby pressing the moving member 340 in the direction O.

With reference to FIG. 6, the dust separator 110 is rotated about the hinge shaft X in direction A so that the user can remove only the dust receptacle 120 when it is filled with dust.

As can be appreciated from the above description, when using a vacuum cleaner equipped with features according to some embodiments of the present invention, the dust receptacle 120 can be removed alone from the cleaner body 11 by separating the dust separator 110 and the dust receptacle 120 from each other using the locking unit 220. Accordingly, removal of the dust collected in the dust receptacle 120 is simplified.

In addition, since the user does not have to apply a great force to separate the dust separator 110 from the dust receptacle 120, the dust in the dust receptacle 120 is not easily bounced out by the applied force, and therefore does not get on the user's hand or other surfaces.

Furthermore, after the dust separator 110 and the dust receptacle 120 are released from each other by the opening unit 300, the user can easily remove the dust receptacle 120 from the cleaner body 110 without having to rotate the dust separator 110.

While the invention has been shown and described with reference to certain embodiments thereof, it will be understood by those skilled in the art that various changes in form and details may be made therein without departing from the spirit and scope of the invention as defined by the appended claims.

What is claimed is:

1. A vacuum cleaner comprising:

a cleaner body in which a dust separator is rotatably mounted to extract dust from dust-laden air;

a dust receptacle detachably mounted in the cleaner body and disposed below the dust separator;

a locking unit locking and releasing the dust separator and the dust receptacle with respect to each other, the locking unit comprising:

a button formed on a handle of the dust receptacle and having a hook;

a fastening part provided to the dust separator to lock and release the hook;

a first resilient member pressing the button in a direction for locking the hook; and an opening unit rotating the dust separator by a predetermined angle when the dust separator and the dust receptacle are released from each other.

2. The vacuum cleaner of claim 1, wherein the dust separator comprises one of a mono-cyclone unit and a multi-cyclone unit.

3. The vacuum cleaner of claim 2, further comprising a cover rotatably mounted to the cleaner body, and wherein the dust separator is connected to the cover.

4. The vacuum cleaner of claim 3, wherein the opening unit comprises:

a static member fixed on the cleaner body;

a guide mounted to the static member;

a moving member mounted to the guide and moving between a first position and a second position; and a second resilient member interposed between the static member and the moving member to resiliently bias the moving member toward the second position.

5. The vacuum cleaner of claim 4, wherein the guide comprises:

a first guide guiding a left side of the moving member; and a second guide fixed into a second guide insertion hole of the moving member.

6. The vacuum cleaner of claim 5, wherein the second resilient member is inserted in the second guide.

7. The vacuum cleaner of claim 1, wherein the fastening part comprises:

a supporting projection protruding from the dust separator; and a hook holder formed on a lower part of the supporting projection.

8. A vacuum cleaner comprising:

a cleaner body in which a dust separator is rotatably mounted to extract dust from dust-laden air, the dust separator including one of a mono-cyclone unit and a multi-cyclone unit;

a dust receptacle detachably mounted in the cleaner body and disposed below the dust separator;

a locking unit locking and releasing the dust separator and the dust receptacle with respect to each other;

an opening unit rotating the dust separator by a predetermined angle when the dust separator and the dust receptacle are released from each other, the opening unit including a static member fixed on the cleaner body, a guide mounted to the static member, a moving member mounted to the guide and moving between a first position and a second position, and a second resilient member interposed between the static member and the moving member to resiliently bias the moving member toward the second position; and a cover rotatably mounted to the cleaner body, the dust separator being connected to the cover.

9. The vacuum cleaner of claim 8, wherein the guide comprises:

a first guide guiding a left side of the moving member; and a second guide fixed into a second guide insertion hole of the moving member.

10. The vacuum cleaner of claim 9, wherein the second resilient member is inserted in the second guide.

* * * * *